US005469925A

United States Patent [19]

Mueller et al.

[11] Patent Number: 5,469,925

[45] Date of Patent: Nov. 28, 1995

[54] DOWNHOLE TUBE TURNING TOOL

[75] Inventors: Mark D. Mueller; John C. McClellan, both of Bakersfield, Calif.

[73] Assignee: Union Oil Company of California, Los Angeles, Calif.

[21] Appl. No.: 132,477

[22] Filed: Oct. 6, 1993

[51] Int. Cl.[6] ..... E21B 7/08

[52] U.S. Cl. ..... 175/61; 175/75; 72/152

[58] Field of Search ..... 175/61, 62, 73, 175/74, 75, 76; 72/152; 166/50

[56] References Cited

U.S. PATENT DOCUMENTS

| | | | |
|---|---|---|---|
| 550,783 | 12/1895 | Elliott et al. | 175/75 |
| 4,062,196 | 12/1977 | Yoshida et al. | 175/73 X |
| 4,223,737 | 9/1980 | O'Reilly | 175/61 X |
| 4,497,381 | 2/1985 | Dickson, III et al. | 175/61 |
| 4,629,012 | 12/1986 | Schuh | 175/75 |
| 4,721,410 | 1/1988 | Recalde | 405/166 |
| 4,757,702 | 7/1988 | Theilacker et al. | 72/152 |
| 5,107,927 | 4/1992 | Whiteley et al. | 166/50 |
| 5,289,888 | 3/1994 | Talley | 175/61 |

OTHER PUBLICATIONS

"Slim-hole casing program adapted to horiontal well" by Leigh Foster, Arco British Ltd., Guildford, England, Oil and Gas Journal, Sep. 6, 1993, pp. 76–81.

The Lance System, A Better Approach to Formation Penetration, Penetrations, 3 pages.

LPT, Lance Penetrator Tool, 4 pages.

TechReport, Penetrator, Inc. The Lance[SM]Formation Penetrator Tool, 3 pages.

Penetrators, Case History, 7 pages.

TechReport, Penetrators, Inc., Penetrator Tool With Nozzle–Punch, 2 pages.

Penetrators, Inc. Lance Penetrator Tool General Charges, 5 pages.

Penetrators, Inc., General Terms and Conditions, Effective Sep. 1, 1990, pp. 3–9.

The Lance Formation Penetrator System, Alan D. Peters, Presented at the Southwestern Petroleum Short Course, Southwestern Petroleum Short Course Associated, Lubbock, Texas., 11 pages.

Petrolphysics Ultrashort Radius Radial System, Recent Technical Papers, 113 pages, 7 papers.

Piping Handbook, Reno C. King, B.M.E., M.M.E., D.Sc., P.E., fifth edition, McGraw–Hill Book Company, pp. 7–124–7–129.

SPE 19412, Evaluation and Treatment of Organic and Inorganic Damage in an Unconsolidated Asphaltic Crude Reservoir, F. P. Efthin, J. J. Garner, and D. M. Bilden, BJ–Titan Service, and S. T. Kovacevich T. C. Pense, Oryx Energy Co., pp. 113–124.

SPE 20073, "Evaluation and Treatment of Organic and Inorganic Deposition in the Midway Sunset Field", Kern County, California, by D. M. Bilden, F. P. Efthin, and J. J. Garner, BJ–Titan Services, and T. C. Pence and S. T. Kovacevich, Oryx Energy Co., pp. 523–538.

*Primary Examiner*—Ramon S. Britts
*Assistant Examiner*—Frank S. Tsay
*Attorney, Agent, or Firm*—William O. Jacobson; Gregory F. Wirzbicki

[57] ABSTRACT

A tube turning tool allows laterals to be drilled and completed without the need for articulated bending tools, underreaming, high fluid pressure, or a separate running of completion tools. The turning tool uses a rigid bent pipe section capable of being run downhole within many standard diameter well tubulars, supported in a desired position, and bending coil tubing at an ultra short radius of curvature as it is being run into the wellbore so that it can jet drill a lateral. After jet drilling a lateral, the lateral can also be completed using the coil tubing, e.g., gravel packed by pumping a slurry through the coil tubing while withdrawing the tubing from the lateral.

23 Claims, 3 Drawing Sheets

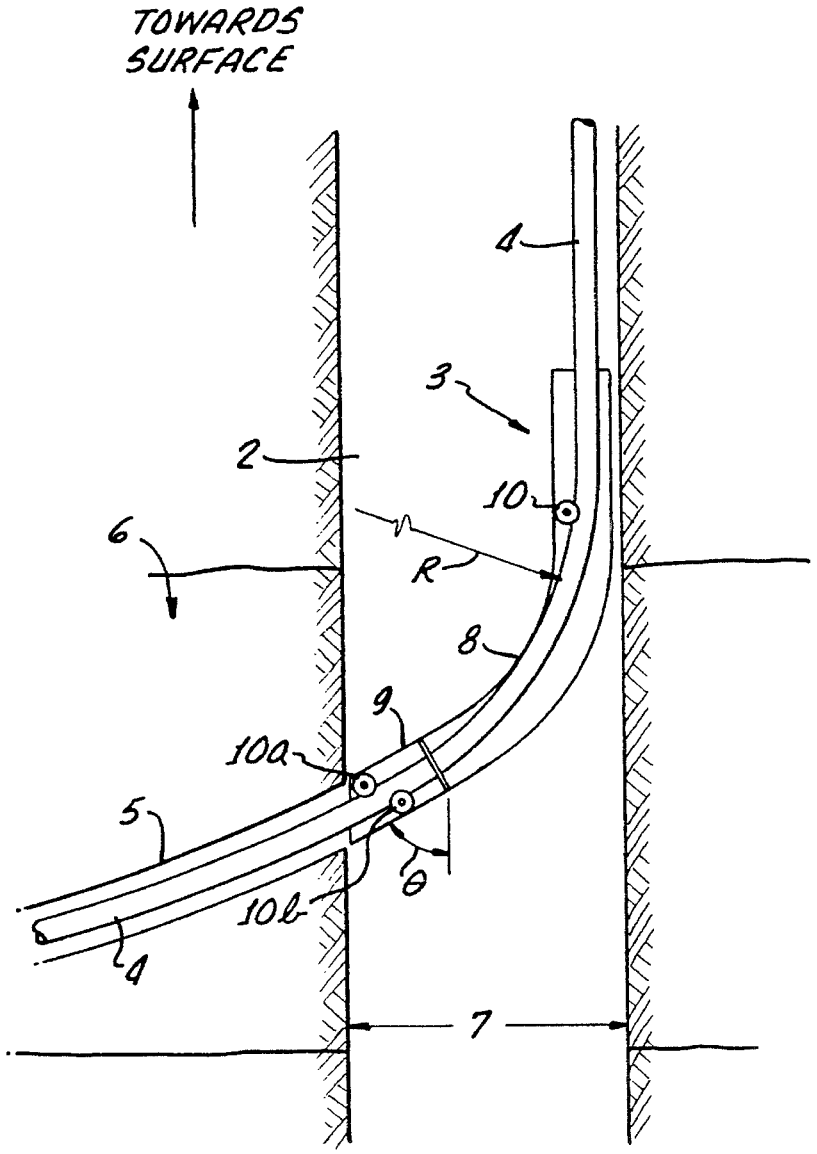
FIG. 1a.
FIG. 1b.
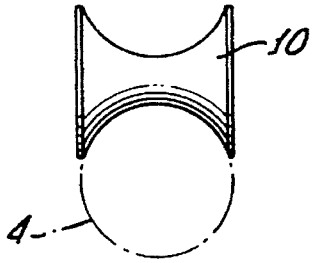
FIG. 1c.
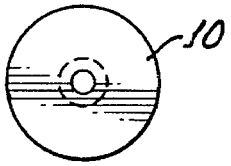

DOWNHOLE TUBE TURNING TOOL

FIELD OF THE INVENTION

This invention relates to drilling devices and processes. More specifically, the invention is concerned with providing a device and method for turning coil tubing within a borehole to drill, complete, and/or withdraw fluid from a lateral cavity connected to the borehole.

Background of the Invention

Coil tubing has been used for several applications in oil wells. The coil tubing is typically supplied reeled on a truck mounted drum which can be rotated to run or retract one end of the tubing into or out of a well. A typical oilfield use is where relatively low differential pressures and/or flows through small diameter conduits are needed, e.g., measuring or obtaining o small downhole fluid samples. Samples/measurements are obtained by placing one end of the coil tubing into an underground borehole (e.g., through a packoff in a wellhead), lowering the end by unreeling the coil tubing into the hole until the desired sampling/measurement location is reached, obtaining the measurement or sample, and reeling the drum and tubing end back up to the surface.

Another application of-coil tubing is to reenter a vertical borehole to jet drill a small diameter horizontal lateral or radial off the borehole. Heavy wall tubing (e.g., capable of containing 10,000 psig internal pressure) has typically been used for this application. The heavy wall contains the high pressure fluid which is accelerated through a nozzle attached to the end of the coil tubing to jet drill the lateral. The heavy wall tubing is also needed to maintain a minimum cross-sectional wall thickness during bending of the tubing from the wellbore to the lateral direction.

Because of the limited space in typical wellbores (e.g., 6¼ inch or 15.88 cm in diameter) and the larger-than-wellbore-diameter minimum tubing radius of curvature that has been achieved by prior art bending tools, articulated bending tools and underreaming of the wellbore have been typically required for turning tools used in typical wellbore diameters. In addition, high internal pressure has been required during downhole tube bending operations.

An example of a prior art tool used to bend (heavier wall) tubing downhole for laterals is an articulated Ultrashort Radius Radial tool supplied by Petrophysics, San Francisco, Calif. The Petrophysics tool is typically installed in a 24 inch underreamed zone in the wellbore in order to actuate and bend 1¼ inch nominal OD tubing. The tubing is pressurized to about 10,000 psig during running and bending tubing through the tool.

After jet drilling the lateral using coil tubing, the tubing and tool are typically withdrawn to allow completion (e.g., gravel packing) and operation (e.g., production of formation fluids such as oil). Removal of the Petrophysics tool also requires deactuation of the articulated bending mechanism prior to pulling the tool out of the hole.

In addition to the need for underreaming, high pressure, actuation/deactuation of the turning tool, and separate running/removal of the tool prior to gravel packing and operation, other difficulties are associated with using coil tubing for drilling laterals. When the coil tubing is uncoiled from the drum, a residual bend typically remains, i.e., most, but not all of the bend from coiling is removed by uncoiling. This residual bend can result in deviations during operations using the coil tubing. If the residual bend is fully removed, the coil tubing may be workhardened, risking failure when the tubing is turned into the lateral. The work hardening and/or residual bend may also cause added contact and frictional forces during running of the tubing. The residual bend may also cause unwanted positioning of the tubing within the wellbore.

SUMMARY OF THE INVENTION

The present invention provides a rigid tube turning tool assembly which allows laterals to be drilled and completed without the need for high fluid pressures, articulated bending tools, underreaming, and/or separate running of turning and completion tools. The rigid tube turning tool comprises a rigid bent pipe section capable of being run downhole within many standard diameter boreholes, is supported in a desired position within the borehole, and can bend low pressure/unpressurized coil tubing run through it. The coil tubing is deformed, preferably in the same direction as its residual bend, by the turning tool at an ultra short radius of curvature while being supported against buckling by either the proximate surfaces of the bent pipe section and/or (in the preferred embodiment) by rollers. After jet drilling a lateral, the lateral can be completed using the coil tubing without removing the turning tool, e.g., gravel packed by pumping a slurry through the coil tubing while withdrawing the tubing from the lateral through the tool. After completion of the lateral, the coil tubing is typically run out of the hole and the tool can be repositioned to drill and complete other laterals using new tubing to avoid work-hardening, buckling, or other tubing failure.

The invention bends tubing to a smaller radius of curvature than prior downhole tools. It also achieves the small radius bending without the need for high internal pressure within the tubing. The resulting deformed tubing may be distorted in cross section, but the tubing is still capable of conducting sufficiently pressurized fluids or slurries to jet drill and complete a lateral.

BRIEF DESCRIPTION OF THE DRAWINGS

FIGS. 1*a*, 1*b*, and 1*c* show a cross-sectional side view of a tube turning assembly and roller components;

In these Figures, it is to be understood that like reference numerals refer to like elements or features.

DETAILED DESCRIPTION OF THE INVENTION

Figure 2:
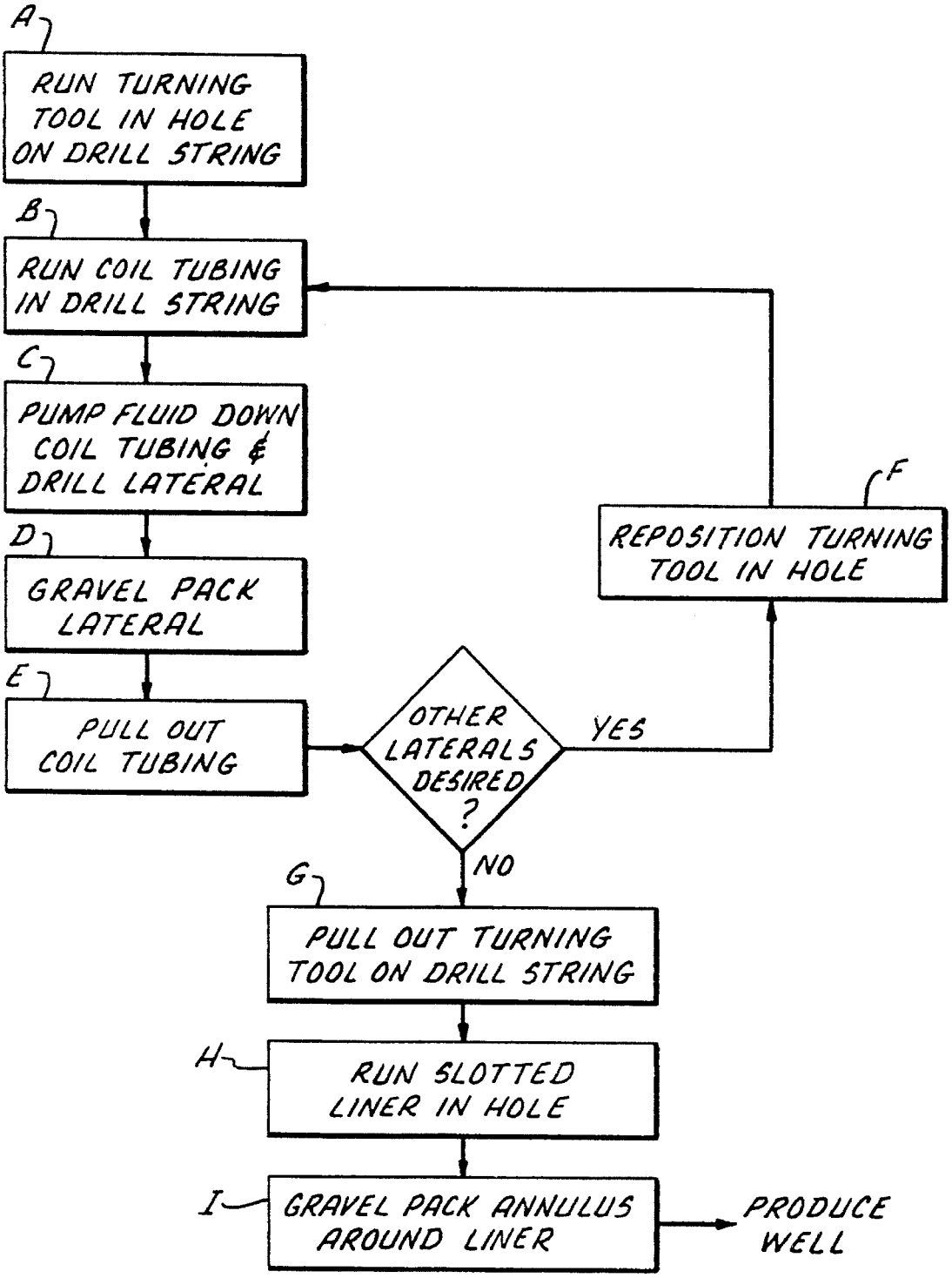
FIG. 2 shows a process flow diagram of a method for drilling a lateral using the tube turning assembly shown in FIG. 1.

FIG. 1*a* shows a cross-sectional view of an underground wellbore portion 2 within which a tube turning tool or deforming assembly 3 is installed. The tube turning assembly 3 is shown deforming coil tubing 4 which is being run downwards through the wellbore 2, the tube turning assembly 3, and deformed radially outward towards a lateral cavity 5.

The wellbore 2 is conventionally drilled or bored, e.g., by conventional rotary drilling, into a formation 6. The wellbore portion 2 shown may also be cased or lined with a tubular. Although the wellbore 2 typically extends towards the surface, the wellbore portion of interest is proximate to (and penetrates) the oil-bearing formation 6 or other formation of interest. One or more lateral cavities 5 having a radially outward directional component may be drilled from the wellbore portion 2 into the oil-bearing formation 6 before or after the wellbore portion is cased or lined. The lateral cavities typically allow oil or other fluids to be more easily withdrawn from the formation or injected into the formation.

Wellbore portions 2 in oil-bearing formations have nominal diameters that are typically less than 10 inches (25.4 cm), preferably less than 8 inches (20.32 cm), still more preferably less than 6 inches (15.24 cm). For example, a nominal 5½ inch (13.97 cm) slotted liner is a typical size at oil well production intervals in some formations. Although portions of the wellbore closer to the surface may have a larger diameter to accommodate flashing gas or other reasons, larger diameters at depths proximate to the formation of interest are not typically needed.

Many conventional wellbore or borehole portions 2 are vertical or nearly vertical (e.g., having centerline within 3 degrees of vertical). Short lateral cavities 5 from these wells typically extend nearly horizontally, but longer lateral cavities 5 may also follow a trendline in the formation. When the wellbore is deviated or nearly horizontal, laterals may also be beneficially drilled. Short lateral cavities 5 may extend as little as a few feet radially outward (from the wellbore portion 2 centerline), but typically extend a distance (having a radially outward directional component) at least 10 feet (3.048 meters) from the wellbore centerline, more typically ranging from about 50 to 200 feet (15.24 to 60.96 meters).

The lateral cavities 5 may be jet drilled using a nozzle and the outwardly deformed tubing 4 exiting the tube deforming assembly 3 or the deformed tubing may be used in other operations involving a predrilled lateral cavity 5, such as maintenance or sampling. If the tubing 4 is used for drilling, pressurization and flow of a jet cutting fluid or slurry are typically required. The internal fluid pressures needed to jet drill vary with the type of formation being drilled and may be greater than about 10,000 psig (681 atmospheres), but are typically less than about 10,000 psig (681 atmospheres), more typically less than about 5,000 psig (341 atm).

The preferred tubing 4 is coilable tubing, typically ranging in nominal outside diameter from about 0.25 inch to 2 inches (0.635 to 5.08 cm) and preferably less than 1½ inches (3.81 cm). The coil tubing 4 is supplied at the surface on a conventional truck mounted drum (not shown) which is unreeled to run the coil tubing down to the wellbore portion 2. For example, a 1⅛ inch nominal OD coil tubing 4 is preferably composed of seamless stainless steel and has a nominal wall thickness of 0.087 inch, but may have a wall thickness ranging from about 0.067 to 0.156 inch (0.170 to 0.396 cm). The 0.087 inch wall thickness tubing has a nominal burst pressure rating of about 11520 psig (785 atm). Safe operating pressures for this wall thickness tubing would typically be significantly less than 10,000 psig (681 atm). An alternative tubing would be a nominal 1 inch (2.54 cm) OD tubing having a wall thickness ranging from about 0.062 to 0.109 inches (0.157 to 0.277 cm) depending upon safe operating pressures required for bending and/or jet drilling.

Means for running the tubing is typically a motor driven drum uncoiling the tubing into the well, but other conventional running means may be used. This includes caterpillar-like tubing grips, sequential clamping and unclamping, and tracked tubing attachments.

The turning tool 3 is composed of a rigid bent pipe section 8, a straightening section 9, and rollers 10. The rigid bent pipe section 8 is shaped to closely contain coil tubing being run through it, e.g., the inside diameter of the rigid bent pipe section is typically no more than 1.5 times the nominal outside diameter of the tubing 4, more typically no more than only 1.25 times the nominal outside diameter.

Figure 3:
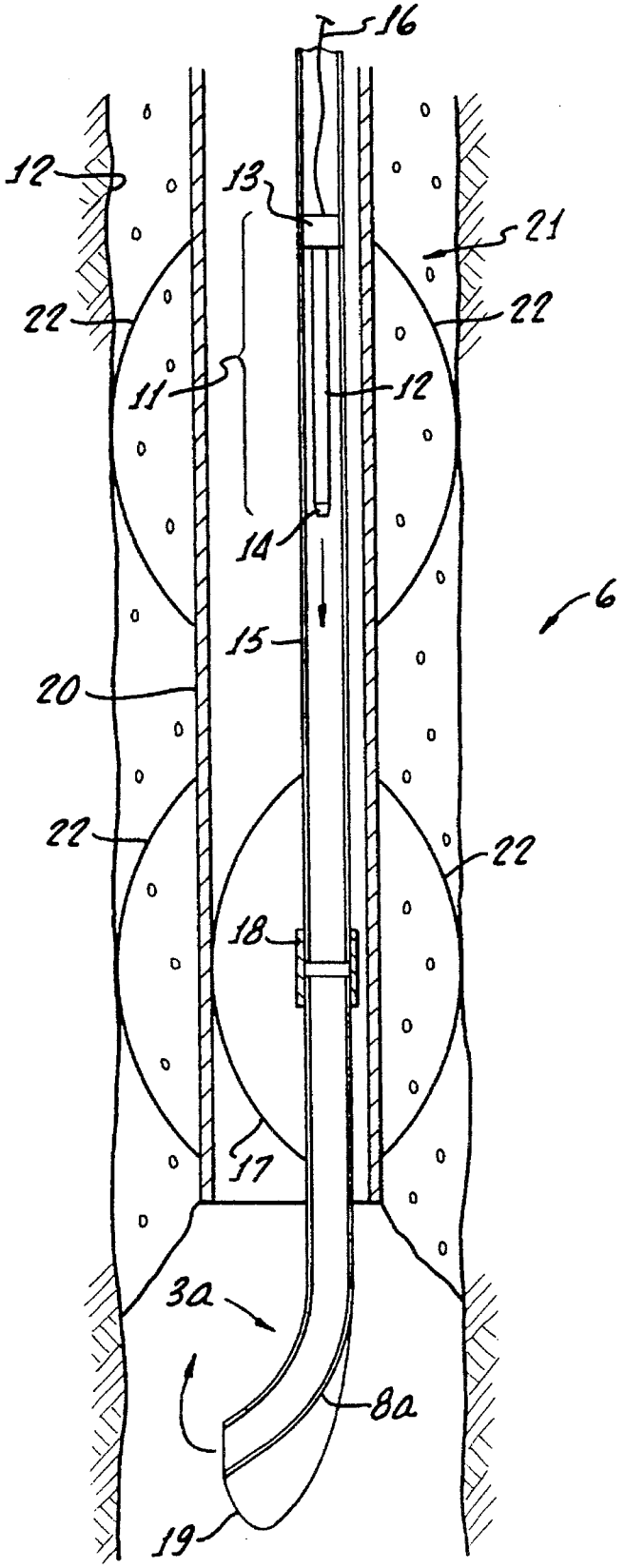
FIG. 3 shows a cross-sectional view of an alternative tube turning assembly in a wellbore.

Means for fixing the turning tool 3 in place may be an attachment to the casing, but more typically the turning tool 3 is held in place on a work string (see FIG. 3). The work string allows the turning tool 3 to be run into the wellbore, positioned and oriented, and repositioned, if necessary. If a work string is used, the tubing 4 is run within the work string prior to entering the turning tool. Other means for fixing the turning tool include inflatable packers, wirelines, rods, and pressure balancing.

Upon entering the bend of the turning tool 3, the lower end of the tubing 4 is forced or deformed towards the lateral cavity 5. As the tubing end is forced to move laterally, the side of the tubing contacts a first pulley or bending roller 10. The first roller 10 is rotatively mounted on a shaft attached within the turning tool 3, providing an internal rolling surface around which the tubing 4 can bend without buckling. The first roller 10, as also shown in FIGS. 1*b* and 1*c*, is shaped to contactably mate with a substantial portion of the half circumference of the tubing 4. This contact portion of the tubing is compressed during bending, i.e., the length of the roller as shown in FIG. 1*b* is preferably a substantial fraction of the nominal diameter of the tubing 4 (shown dotted for clarity in FIG. 1*b*) to prevent compressive buckling.

The tubing 4 may also be oriented so that any residual bend, i.e., any remaining bend after uncoiling the tubing from a surface mounted drum, is in the direction of the bending accomplished by the turning tool 3. The first roller, the confinement of the tubing within the bent pipe section, and/or the orientation of the residual bend (avoiding added work hardening) allow the tubing 4 to be deformed into a shape having an ultra short radius of curvature. The radius of curvature for a 1 inch nominal OD tubing can be less than about 6 inches (15.24 cm), but is more typically is less than about 8 inches (20.32 cm), still more typically less than about 12 inches (30.48 cm). This ultra-short curvature allows the rigid pipe section to be run into a typical size of wellbores 2 without high internal pressure stabilizing the tubing, without underreaming and/or without downhole actuation of bending equipment. Although a less than 90 degree angle 73 is shown on FIG. 1, a rigid pipe section turning tool having a 90 degree angle can also be run downhole within typical sizes of wellbores.

The straightening section 9 includes straightening rollers 10*a* and 10*b*, similar to first roller 10. However, rollers 10*a* and 10*b* are placed to remove a substantial portion of the (possibly combined) residual bend after the tubing is run through the rigid pipe section 8. The function of the straightening rollers, to provide rolling, anti-buckling support during (straightening) deformation of the tubing 4, is also similar to roller 10. Although two straightening rollers 10*a* and 10*b* are shown, only one may be required in a given application.

The straightened tubing 4 enters the lateral cavity 5 upon exiting the straightening section 9. The tubing 4 may be used to drill the cavity 5 or otherwise operate within the lateral cavity 5. When the operation using the tubing within the lateral cavity 5 is complete, the tubing is withdrawn from the lateral cavity through the turning tool 3. The straightening rollers 10*a* and 10*b* may now serve as bending rollers while the first roller 10 may serve as a straightening roller as the tubing is re-bent and re-straightened prior to pulling out of the wellbore.

A process for using the tube turning tool (shown in FIG. 1*a*) and drilling a lateral using a completion or other type of drilling related rig is shown in FIG. 2. The process assumes a wellhead is in place and a wellbore or hole has been previously drilled with a 9⅞ drill bit and a 7 ⅝ inch casing has been cemented to the wellbore. Before using the tube turning tool, the hole should have been cleaned out (e.g., with a 6¾ drill bit) and inserts, shoes, and shoe joints (if any), drilled out, and the fluid in the hole changed out to a clean (e.g., HEC) completion fluid. Step "A" of the process is to pick up the tube turning tool on a nominal 2⅞ inch, 6.5 #, N-80 drill string and run the tube turning tool in hole. The turning tool's orientation (azimuth) and depth are measured while running the turning tool and drill string into the hole. At the desired measured depth and azimuth, the drill string (and slips) are set and a circulating line on the wellhead opened.

Step "B" is to run coil tubing into the hole after installing and testing a tubing packoff at the wellhead. A first piece or portion of #1 coil tubing is run in hole with a jetting nozzle attached forming one continuous length of tubing. Additional coil tubing from a mobile coil tubing unit (CTU) at the surface is run into the wellbore behind the first piece. A typical specification for coil tubing reeled on a drum mounted on the CTU is typically 1.25 inch nominal outside diameter, 1.8 #, and N-80. Although the nominal outside diameter of the 1.25 inch tubing is almost 20 percent of the 6 ¾ inch nominal diameter of the cleaned out borehole, a coil tubing having smaller diameter (as a percentage of the wellbore) may be desirable. The length of the coil tubing is unreeled and run within the drill string sufficient to reach the turning tool.

When the end (first piece) of the continuous coil tubing reaches the turning tool, the jet cutting tool and first tubing piece is diverted toward the desired lateral and azimuthal direction (by the turning tool). The diversion is typically in the absence of high internal fluid pressure within the coil tubing, e.g., pressure equal to or greater than about 10,000 psig (681 atm). Although some internal fluid pressure during bending is typical, pressures do not typically exceed 5,000 psig (341 atm) and are more typically less than 2,000 psig (137 atm).

Step "C" flows a pressurized cutting fluid within the coil tubing to the diverted jet nozzle. The cutting fluid is typically pressurized within the range of about 1,000 to 10,000 psig (69.0 to 681 atm), more typically the more narrow range of about 2,000 to 5,000 psig (137 to 341 atm). The cutting fluid, typically consisting of HEC and water, is accelerated through the jet drilling nozzle to cut laterally outward into the formation from the borehole, forming a lateral cavity. A gel mixture or solid-liquid slurries may also be used as cutting fluids.

Although the theoretical length of a lateral is unlimited, the typical length of a lateral drilled using the rigid bending tool ranges from about 20 to 100 feet (6.096 to 30.48 meters) if the tubing is straightened and significantly less if the tubing is not straightened. The diameter of the jet drilled lateral may be similar to the coil tubing, but outward-facing jets may also cut a larger diameter lateral. The diameter of the jet drilled lateral typically ranges from about 2 to 12 inches (5.08 to 30.48 cm).

Step "D" is to gravel pack the lateral after attaching a gravel pack supply and slurry flow equipment to the coil tubing. Prior to gravel packing, the HEC fluid may need to be dumped and replenished or replaced with a different (packing) fluid. The fluid may also be modified, e.g., to keep the solids content below a desired level, such below about 0.5 percent by volume. Gravel packing solids are typically carried by the packing or completion fluid as a slurry through the coil tubing/nozzle and separated from the fluid in the lateral cavity as the coil tubing is withdrawn from the lateral. Conventional means for supplying a gravel pack slurry are preferred, such as mud pumps and fluid storage/mixing tanks, but may include other types of fluid or slurry pumps and sources of plastic or other solid components of a liquid-solid mixture. A water based liquid component of the slurry is typical, but oil or other fluid bases are also possible.

In order to pass through a typical jet drilling nozzle while the tubing is being pulled out, the gravel size range in the slurry used to pack laterals is expected to range from 40 to 60 mesh. The typical gravel slurry has a gravel concentration ranging from 1 to 3 pounds per gallon (ppg). Erosion of the jet drilling nozzle(s) by the accelerated slurry is also expected (unless nozzles are hardened or otherwise protected). However, the erosion is acceptable because the jet drilling with this nozzle is typically complete at this point in the process.

Step "E" pulls the coil tubing and nozzle out of the hole. The coil tubing and nozzle pulled out of the hole is typically not reused because of nozzle erosion and/or the risk of tubing failure upon repeated bending around the ultra-short radius turning tool.

If additional laterals are desired, step "F" re-positions and reorients the turning tool to another location within the hole. The additional laterals are typically drilled and packed by repeating process steps "A" through "E" using new tubing (from the CTU) and nozzles for each lateral.

If no further laterals are desired to be drilled, step "G" pulls the turning tool and drill string out of the hole. A clean out of the hole (using a clean-out bit on a drill string) may be required after pulling the tubing and turning tool from the hole to remove cuttings and other debris.

Step "H" runs a slotted liner into the wellbore to the proximity of the lateral(s). A typical slotted liner is a 5½ inch nominal diameter, 17#, K-55 with slots 24-2-6-50 gauge. The slotted liner is typically hung from the nominal 7⅝ inch casing.

Step "I" gravel packs around the slotted liner. The gravel is typically packed with conventional over-the-top tools and uses 8–12 mesh gravel. Packing is typically accomplished at a rate of 200 to 300 cu ft/hr. After gravel packing around the annulus of the slotted liner, the drill strings, tools, wellhead blowout preventors, and rig can be removed and the well produced.

FIG. 3 is a cross-sectional view of an alternative tube turning tool 3*a* attached to a work string 15 within a wellbore 2 prior to jet drilling a lateral using an alternative procedure. The alternative turning tool 3*a* is shown during a pumping down process step where a coil tubing cutting element 11 is being run down within the work string 15. The coil tubing cutting element 11 includes a coil tubing segment 12, a pumping pack off assembly 13, and a jet drilling nozzle 14.

The coil tubing segment 12 is cut from a CTU and is typically assembled (at the surface) to the nozzle 14 and the pumping pack off assembly 13. After placing the coil tubing cutting element 11 into a work string 15 and attaching fluid pumping equipment (not shown) to the work string, the cutting element 11 is pumped down slowly to the alternative turning tool 3*a*. Wellhead pressures typically range from about 2,000 to 5,000 psig (137 to 341 atm) during the pump down process.

As shown by flow arrows in FIG. 3, the pump down of the cutting element 11 also produces a fluid flow through the work string 15, the pack off assembly 13, the coil tubing segment 12, the nozzle 14, the alternative turning tool 3*a*, and back up to the wellhead (not shown) through the remaining annular space in the wellbore 2. Return fluid flow is typically recycled to a surface pump (not shown) and returned pressurized to the work string 15.

The pumped fluid flow creates a pressure drop across the nozzle 14, resulting in an unbalanced downward force pulling on (i.e., pumping down) the cutting element 11. The downward force translates (or runs) the cutting element 11 downward to the turning tool 3a which deviates and deforms a portion of the running coil tubing segment 12 outward towards the desired lateral location.

When the nozzle 14 is proximate to the wellbore 2, the fluid pressure drop at the nozzle creates a jet cutting action allowing the cutting element 11 to drill into the formation 6, forming a lateral cavity similar to that shown in FIG. 1. The jet drill cutting is accomplished while added portions of the coil tubing segment 12 translate and deform around the ultra-short radius bend of the alternative turning tool 3*a*.

When drilling of the lateral is complete, rods 16 and an overshot tool (not shown) are used in the preferred embodiment to catch the upper end of the cutting assembly 11. If the lateral does not require gravel packing, the cutting element 11 can be pulled out of the wellbore using one or more attached rods 16. If gravel packing of the lateral is desired, a gravel slurry can be introduced through the work string 15 and discharged from the cutting element 11 as the cutting element is being withdrawn from the lateral by the rods 16. In an alternative process embodiment (shown in FIG. 3) and procedure, a wireline (in place of rod 16) is attached to the cutting assembly prior to running in hole and uses the pump down process step to also draw the wireline downhole. The alternative embodiment with the wireline attached avoids the need for rods 16 and an overshot tool (not shown) and the step of catching the upper end of the cutting element 11.

The work string 15 is similar to the piping used in the drill string and discussed with respect to FIG. 2, but the work string is biased towards one side of the wellbore 2 by a work string centralizer or bias element 17 attached to the work string. The work string centralizer 17 bears at the azimuth where the lateral is desired to be drilled after the work string 15 is run and positioned in the wellbore 2.

A typical centralizer 17 comprises a bowed spring steel element which is attached at two locations around the pipe joint 18 connecting the work string 15 to the alternative turning tool 3*a*. The work string centralizer 17 forces pipe joint 18 against the portion of wellbore 2 opposite to the desired drilling direction. The wellbore contacting points (on the centralizer 17 and pipe joint 18) may be lubricated to minimize frictional drag when running the work string 15 into and out of the hole.

The work string 15 and attached alternative turning tool assemble 3*a* are run into the wellbore 2 and positioned similar to the process described with respect to FIG. 2. The alternative turning tool 3*a* includes a tool guide 19 attached to an alternative rigid turning element 8*a* (similar to the rigid turning element 8 shown in FIG. 1). The tool guide 19 assists in centering and guiding the assembly as it is run into the hole. Although the attached base of the tool guide 19 is shown as having a shape mating with the alternative rigid turning element 8*a*, an alternative shape radially extends slightly beyond the radial extent of the rigid turning element 8*a*. The extended base tool guide tends to protect the fluid end opening of the rigid turning element 8*a* during running operations.

No straightening segment (similar to the straightening segment 9 as shown in FIG. 1) is needed for drilling a very short lateral. After exiting the deforming segment 8*a*, the deformed coil tubing will not be straight, but will typically partially relax (or unbend) to a shape having a radius of curvature greater than the shape of the rigid turning segment 8*a*, i.e., the coil tubing recovers the elastic deformation, but not the plastic deformation accomplished by the turning segment 8*a*. However, if longer and/or straighter laterals are desired, a straightening segment similar to one shown in FIG. 1 can be provided.

FIG. 3 shows a turning tool 3*a* positioned below a casing 20 and hardened cement 21 holding the casing to the wellbore 2. Also shown are casing centralizers 22 which center the casing during cementing prior to the cement hardening. Alternatively, the casing may cover the desired lateral location and is perforated prior to drilling the lateral. The lateral drilling process is accomplished through one or more perforations.

Although not required for drilling the lateral, the wellbore 2 may also be undercut near the lateral location (i.e., the wellbore is drilled out to a larger diameter than adjoining portions of the wellbore). Undercutting allows room for cuttings from the drilling of the lateral (or other debris) to accumulate. Since undercutting is not required for bending, the amount of undercutting (if any) can be less than previously required.

Gravel packing of the laterals can also be accomplished using the cutting element 11. Similar to that previously described with respect for the process shown in FIG. 2, a fine mesh gravel slurry can be pumped down through the work string 15 and cutting element 11 while the rod(s) 16 or a wireline slowly pulls the cutting element back from the lateral cavity.

When gravel packing is completed, the cutting element 11 is typically pulled out of the hole. If no other laterals drilled from the wellbore are desired, the work string with attached turning tool 3*a* is also pulled out of the hole. If other laterals are desired, the work string 15 is repositioned to place the attached turning tool 3*a* proximate to the desired location and the alternative process repeated.

When the last lateral cavity has been drilled and gravel packed, a slotted liner may also be run into the wellbore. The slotted liner may also be gravel packed similar to that described for the process shown in FIG. 2.

The turning tool allows one or more lateral cavities to be drilled using coil tubing without the need for an articulated bending tool, without the need to actuate the articulated bending tool downhole, without the need for undercutting the wellbore to provide room for the actuated bending tool, and without the need for withdrawing the coil tubing prior to gravel packing the lateral(s). It is not completely clear why this smaller (than prior art) radius can be achieved using the above-discussed procedures, but some reasons may include acceptance of greater out of round tolerances when compared to commercial bent pipe, orientation of the residual bend in the coil tubing, and the use of side bias elements. The invention also allows sampling, cementing, testing, and other operations requiring downhole bending (and straightening) of coil tubing.

Still other alternative embodiments are possible. These include: at least a double set of rollers for bending and straightening, providing the nozzle face with a frangible or acid dissolvable disc or a perforation plug (allowing the discharge of gravel pack without eroding the jet orifices and/or larger gravel sizes), providing the coil tubing with frangible or acid dissolvable perforation plugs and leaving it within the lateral cavities (allowing the coil tubing to also function as a slotted liner), and using an elevated temperature of the cutting fluid during bending to further ease deformation of the tubing around the rigid bent pipe section.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An apparatus for deforming a tube having a nominal outside diameter ranging from about 0.25 to 2 inches when said tube is within an underground borehole, said apparatus comprising:

a pipe assembly comprising a rigid bent pipe capable of plastically deforming said tube when said tube is forced from a first end to a second end of said bent pipe, said rigid bent pipe having a centerline and a minimum inside diameter around the centerline less than 1.5 times a nominal outside diameter of said tube, and wherein at least a portion of said centerline forms an arc having a radius of curvature no more than 6 times the nominal outside diameter of said tube, said pipe assembly also comprising a rigid straightening pipe attached at a first straight end to said second end of said bent pipe, wherein said rigid straightening pipe is capable of substantially straightening said tube after being deformed within said rigid bent pipe when said tube is forced from said first straight end to a second straight end of said straightening pipe;

means for substantially fixing a position of said rigid bent pipe within said borehole;

a first roller rotatively attached within said bent pipe and located so as to provide a bearing surface to deform said tube as said tube is inserted through said bent pipe; and a second roller rotatively attached within said pipe assembly and located so as to provide a bearing surface to straighten said tube as said tube is inserted through said straightening pipe.

2. The apparatus of claim 1 wherein said bent pipe and straightening pipe comprise a single pipe forming said pipe assembly and said pipe assembly also comprises a third roller attached to said pipe assembly so that said pipe assembly is capable of re-deforming said straightened tube while said straightened tube is being withdrawn from said pipe assembly.

3. The apparatus of claim 2 which also comprises:

means for running said tube through said pipe assembly;

an orifice attached to said tube wherein said orifice is capable of jet drilling a substantial portion of a tubular cavity extending outward from said tubular when pressurized fluid is supplied to said straightened tube after said tube is straightened; and means for supplying a gravel packing slurry to said tube, wherein said slurry comprises solid particles capable of passing through said orifice.

4. The apparatus of claim 3 wherein said tubular cavity has a nominal diameter of less than about 25.4 cm and wherein a plurality of rollers are attached inside said bent pipe.

5. The apparatus of claim 4 wherein said tubular cavity has a centerline which is substantially within 3 degrees of the vertical downward direction and wherein said lateral cavity extends substantially outward from said tubular centerline a distance of less than 60.96 meters and at an angle from said vertical downward direction of less than about 90 degrees and wherein said tube has a nominal outside diameter of less than about 5.08 cm and said bent pipe has a minimum inside diameter of greater than about 5.08 cm.

6. The apparatus of claim 5 wherein said borehole also comprises a tubular portion and wherein said means for substantially fixing the position comprises a work string capable of supporting said pipe assembly within said tubular portion.

7. The apparatus of claim 6 which also comprises:

a centralizer attached to said work string; and a guide attached to said pipe assembly for centering an end of said pipe assembly within said borehole.

8. The apparatus of claim 7 wherein said centralizer comprises a bowed spring attached to said work string.

9. The apparatus of claim 7 wherein said guide radially extends beyond said second end.

10. A tube turning apparatus for turning a substantially cylindrical tube portion having a nominal diameter of less than about 2 inches comprising:

a rigid deforming element capable of outwardly turning said tube portion when said tube portion is run through said rigid deforming element located in a substantially cylindrical underground cavity having a nominal inside diameter and in the absence of articulated tube bending equipment, wherein the nominal inside diameter of said cavity proximate to said deforming element is less than 8 times the nominal outside diameter of said tube portion;

means for running said tube portion through said deforming element from an entrance to an exit; and means for fixing said rigid deforming element at a location within said cavity.

11. The apparatus of claim 10 which also comprises a rigid straightening element attached to said rigid deforming element and capable of substantially straightening said tube portion after exiting from said rigid deforming element.

12. An apparatus for bending a substantially cylindrical tube within an underground cavity having an inside diameter, said tube having a nominal outside diameter of less than 2 inches, said apparatus comprising:

means for deforming a portion of said tube when said means for deforming is located within said cavity and capable of outwardly turning said tube portion being run into said underground cavity in the absence of articulated tube bending equipment, wherein the inside diameter of said cavity proximate to said tube deforming element is less than 8 times the nominal outside diameter of said tube portion;

means for running said tube through said means for deforming; and means for fixing the location of said means for deforming element within said cavity.

13. A process for drilling an underground well having at least one lateral cavity portion outwardly extending from a substantially cylindrical borehole portion which penetrates an underground formation, said process using coilable tubing having a nominal outside diameter and comprising the steps of:

rotatively drilling said borehole portion having a nominal inside diameter less than about 12 times the nominal outside diameter of said tubing;

inserting a rigid bent pipe assembly into said borehole;

fixing an underground location of said rigid bent pipe assembly within said borehole; and running said coilable tubing through said rigid bent pipe assembly in said fixed location so as to deform a portion of said tubing in a direction having a component radially outward from said borehole portion and then straightening the. portion of said tubing, said running step being in the absence of steps to pressurize said tubing to greater than 341 atmospheres and in the absence of a tubing deforming step using an articulated tube bending device.

14. The process of claim 13 which also comprises the step of coiling said tubing on a transportable drum rotatable around a centerline, said step of coiling being accomplished prior to said rotary drilling step and wherein said running step also comprises;

unreeling said tubing from said drum wherein said tubing has a residual bending deformation after said unreeling step, said bending deformation being in a direction within a plane extending radially outward from the drum; and orienting said drum such that said plane containing said residual bending deformation is substantially parallel to a plane containing said tubing after being deformed outward from said borehole portion.

15. The process of claim 14 wherein said running step also comprises the step of supplying pressurized fluid to said tubing so as to jet drill a lateral cavity in a direction radially outward from said borehole portion and substantially within said formation.

16. The process of claim 15 which also comprises the steps of:

attaching a source of a pressurized slurry to said tubing; and after said running step, withdrawing said tubing from said lateral cavity while flowing said slurry so as to form a gravel pack at least in part within said lateral cavity.

17. The process of claim 16 which also comprises the step of running a slotted liner into said borehole after said withdrawing step.

18. The process of claim 17 which also comprises the step of gravel packing said slotted liner within said borehole.

19. A process for excavating an underground well having a borehole extending from a surface to a formation of interest and at least one lateral cavity extending outwardly from said borehole into said formation, said process using coil tubing having a nominal outside diameter no larger than about 20 percent of the inside diameter of said borehole near said lateral cavity, said process comprising the steps of:

running a rigid bent pipe within said borehole from said surface to a location proximate to said underground formation, said bent pipe having an inside pipe diameter less than 1.5 times said nominal tubing outside diameter;

placing a coil tubing drum such that an uncoiling plane of rotation containing portion of the drum and coil tubing is substantially parallel to a well plane containing portion of said borehole and lateral, wherein any residual bend remaining in the coil tubing after uncoiling is not substantially unbent during subsequent running through said rigid bent pipe; and uncoiling and running said coil tubing through said rigid bent pipe proximate to said formation so as to outwardly deform a portion of said tubing, said running being in the absence of fluid pressures within said tubing greater than 10,000 psig and in the absence of deforming said tubing by articulated tube bending equipment.

20. A process for drilling and packing at least one lateral cavity outwardly extending from an underground borehole portion using coil tubing, said process comprising:

attaching a jet drilling nozzle to a portion of said coil tubing;

moving said coil tubing portion through said borehole to a lateral cavity location to be drilled;

supplying pressurized fluid to said coil tubing sufficient to drill said lateral cavity while continuing to move said coil tubing portion through said borehole and into said lateral cavity until said lateral cavity is drilled; and providing a gravel slurry to said coil tubing while withdrawing said coil tubing from said lateral cavity and without a subsequent step removing said nozzle.

21. The process of claim 20 which also comprises the step of separating gravel particles from said gravel slurry after discharging from said nozzle in said lateral cavity.

22. The process of claim 21 which also comprises the step of running a slotted liner into said borehole after said providing step.

23. The process of claim 22 which also comprises the step of gravel packing said slotted liner after said running a slotted liner step of.

* * * * *

UNITED STATES PATENT AND TRADEMARK OFFICE

CERTIFICATE OF CORRECTION

PATENT NO. : 5,469,925

DATED : November 28, 1995

INVENTOR(S) : Mueller et al.

It is certified that error appears in the above-identified patent and that said Letters Patent is hereby corrected as shown below:

Column 12, line 46 in claim 23, after the second "said" and before "running", insert -- step of --; line 47 after "liner" delete "step of".

Signed and Sealed this

Nineteenth Day of March, 1996

Bruce Lehman

*Attest:*

BRUCE LEHMAN

*Attesting Officer*

*Commissioner of Patents and Trademarks*